US010947652B2

(12) United States Patent
Takaku et al.

(10) Patent No.: US 10,947,652 B2
(45) Date of Patent: Mar. 16, 2021

(54) APPARATUS FOR MANUFACTURING NON-WOVEN FABRIC AND METHOD OF MANUFACTURING NON-WOVEN FABRIC

(71) Applicant: MITSUI CHEMICALS, INC., Tokyo (JP)

(72) Inventors: Shouichi Takaku, Ichihara (JP); Kenichi Suzuki, Ichihara (JP); Naosuke Kunimoto, Yokkaichi (JP); Atsushi Kawada, Tokyo (JP); Takayuki Tanaka, Nagoya (JP)

(73) Assignee: MITSUI CHEMICALS, INC., Tokyo (JP)

( * ) Notice: Subject to any disclaimer, the term of this patent is extended or adjusted under 35 U.S.C. 154(b) by 268 days.

(21) Appl. No.: 16/089,090

(22) PCT Filed: Mar. 24, 2017

(86) PCT No.: PCT/JP2017/012063
§ 371 (c)(1),
(2) Date: Sep. 27, 2018

(87) PCT Pub. No.: WO2017/170242
PCT Pub. Date: Oct. 5, 2017

(65) Prior Publication Data

US 2019/0127897 A1 May 2, 2019

(30) Foreign Application Priority Data

Mar. 30, 2016 (JP) ..... JP2016-068805

(51) Int. Cl.
*D04H 1/736* (2012.01)
*D04H 3/16* (2006.01)
(Continued)

(52) U.S. Cl.
CPC ..... *D04H 1/736* (2013.01); *D01D 5/08* (2013.01); *D01D 5/088* (2013.01); *D01D 5/092* (2013.01);
(Continued)

(58) Field of Classification Search
CPC ..... D01D 5/092; D04H 1/732
See application file for complete search history.

(56) References Cited

U.S. PATENT DOCUMENTS 4,961,695 A 10/1990 Hirschmann et al.
5,503,784 A 4/1996 Balk
(Continued)

FOREIGN PATENT DOCUMENTS

CN 1348513 A 5/2002
JP 6-248556 A 9/1994
(Continued)

OTHER PUBLICATIONS

Yamazaki JPH06248556 Translation (Year: 1994).*
(Continued)

*Primary Examiner* — Jacob T Minskey
*Assistant Examiner* — Adrien J Bernard
(74) *Attorney, Agent, or Firm* — Buchanan, Ingersoll & Rooney PC

(57) ABSTRACT

Apparatus for manufacturing a non-woven fabric includes a diffusing shaft, which includes a first shaft portion in a defined location and provided with a slit-shaped air guide, wherein filaments are supplied together with air from an inlet side of the air guide to an outlet side of the air guide; a second shaft portion in a defined location, having an inlet side that is communicated with an outlet side of the first shaft portion and an outlet side that is disposed to face a filament collecting unit, wherein an opening width along a machine direction of the inlet side of the second shaft
(Continued)

portion is larger than an opening width along a machine direction of the first shaft portion; and a stepped portion provided at a connecting portion between the outlet side of the first shaft portion and the inlet side of the second shaft portion and connecting the same.

4 Claims, 8 Drawing Sheets

(51) Int. Cl.

| | |
|---|---|
| ***D01D 5/098*** | (2006.01) |
| ***D01D 5/088*** | (2006.01) |
| ***D01D 5/092*** | (2006.01) |
| ***D01D 5/08*** | (2006.01) |
| ***D04H 1/732*** | (2012.01) |
| *D01D 7/00* | (2006.01) |

(52) U.S. Cl.
CPC ..... *D01D 5/0985* (2013.01); *D04H 1/732* (2013.01); *D04H 3/16* (2013.01); *D01D 7/00* (2013.01)

(56) References Cited

U.S. PATENT DOCUMENTS

| | | | | |
|---|---|---|---|---|
| 5,795,517 | A * | 8/1998 | Heisler | D04H 1/732 264/115 |
| 5,800,840 | A | 9/1998 | Geus et al. | |
| 6,966,762 | B1 | 11/2005 | Maggio et al. | |
| 8,206,640 | B2 | 6/2012 | Vakili et al. | |
| 2002/0020047 | A1 | 2/2002 | Yoshida | |
| 2008/0317895 | A1 | 12/2008 | Boscolo et al. | |
| 2011/0285053 | A1 | 11/2011 | Koyama et al. | |
| 2013/0099409 | A1 | 4/2013 | Schutt et al. | |

FOREIGN PATENT DOCUMENTS

| | | | |
|---|---|---|---|
| JP | 2556953 | B2 | 11/1996 |
| JP | 2001-008713 | A | 1/2001 |
| JP | 3135498 | B2 | 2/2001 |
| JP | 2002-371428 | A | 12/2002 |
| JP | 4191364 | B2 | 12/2008 |
| JP | 2011-241510 | A | 12/2011 |
| JP | 5094588 | B2 | 12/2012 |
| JP | 2013-087412 | A | 5/2013 |
| KR | 10-2013-0044179 | A | 5/2013 |

OTHER PUBLICATIONS

Fukutani JP-2002371428 Translation (Year: 2002).*

Extended Search Report issued by the European Patent Office in corresponding European Patent Application No. 17774779.7-1107 dated Jul. 22, 2019 (6 pages).

Extended Search Report issued by the European Patent Office in related European Patent Application No. 17774778.9-1107 dated Jul. 22, 2019 (6 pages).

International Search Report (PCT/ISA/210) dated Jun. 6, 2017, by the Japan Patent Office as the International Searching Authority for International Application No. PCT/JP2017/012063.

Written Opinion (PCT/ISA/237) dated Jun. 6, 2017, by the Japan Patent Office as the International Searching Authority for International Application No. PCT/JP2017/012063.

Office Action (Decision of Dismissal of Amendment) dated Apr. 9, 2020, by the Korean Patent Office in corresponding Korean Patent Application No. 10-2018-7028247 and a partial English Translation of the Office Action. (10 pages).

International Search Report (PCT/ISA/210) dated Jun. 6, 2017, by the Japanese Patent Office as the International Searching Authority for related International Application No. PCT/JP2017/012062.

Written Opinion (PCT/ISA/237) dated Jun. 6, 2017, by the Japanese Patent Office as the International Searching Authority for related International Application No. PCT/JP2017/012062.

First Notice of Opinion of Examination dated Jul. 24, 2020, by the State Intellectual Property Office of the People's Republic of China in Chinese Patent Application No. 2017800212295 and a partial English translation of the Notice. (8 pages).

* cited by examiner

APPARATUS FOR MANUFACTURING NON-WOVEN FABRIC AND METHOD OF MANUFACTURING NON-WOVEN FABRIC

TECHNICAL FIELD

The present disclosure relates to an apparatus for manufacturing a non-woven fabric and a method of manufacturing a non-woven fabric.

BACKGROUND ART

Non-woven fabrics such as spunbonded non-woven fabrics find widespread use in medical materials, sanitary materials, civil engineering materials, packaging materials, and the like. A spunbonded non-woven fabric is manufactured from a web obtained by subjecting filaments obtained by melt spinning a thermoplastic resin to a cooling process using cooling wind and a drawing process using drawing wind and thereafter collecting and depositing the filaments on a collecting medium while diffusing the filaments.

Japanese Patent No. 2556953 discloses an apparatus including a cooling chamber whose cross section in the horizontal direction is rectangular, and is gradually reduced in the filament traveling direction, a drawing nozzle connected to the cooling chamber and having a stepped concave portion formed on a wall body at a discharge port, and a filament placement device connected to the drawing nozzle, the apparatus manufacturing a spun filament strip from an aerodynamically drawn synthetic resin filament. The filament placement device of Japanese Patent No. 2556953 has a rectangular cross section in the horizontal direction and has a form of a jet pump including a Venturi annular drainage area in the longitudinal direction and a diffuser outlet, and is configured in such a manner that the amount of air sucked from a free air intake port is adjusted by an intake pipe opposed to the diffuser outlet across a filament strip placement filter belt.

Japanese Patent No. 3135498 discloses an apparatus for manufacturing a spun fleece web from a thermoplastic resin endless filament, comprising a nozzle plate body having a large number of nozzles, a process shaft, a conveying unit, and a conveying conveyor, wherein processing air flows into the process shaft and the conveying unit, endless filament is introduced from a nozzle hole of the nozzle plate body and flows into the process shaft by a discharge motion toward the conveying conveyor as an endless filament group in the form of a mixture of air and filament, the conveying unit includes a central introduction conduit for the endless filament group and a following diffuser conduit extending to the conveying conveyor, the discharge motion and its overlapping fleece forming motion are forcibly imparted, and the two conduits extend in a direction transverse to the direction of travel of the conveying conveyor belt. In Japanese Patent No. 3135498, the introduction conduit and/or the diffuser conduit are used for mixing air and a filament, and the apparatus is configured to includes an aerodynamic equidistribution device including a flow-through slit shape for additional introduction of air into the conduit extending across the direction of travel of the conveying conveyor belt across the width of the conduit and an outflow slit shape for discharging air from the conduit, whereby a flow rate to be additionally supplied and a flow rate of air to be discharged are controlled or adjusted for the purpose of additionally influencing equidistribution of the filament during mixing of air and the filament. In Japanese Patent No. 3135498, the apparatus is configured in such a manner that the inner surface of the introduction conduit and/or the diffuser conduit are provided with an obstruction member in the vicinity of the surface in the longitudinal section of the conduit, whereby a spiral region is formed rearwardly with respect to the flow direction.

Japanese Patent No. 5094588 describes an apparatus for manufacturing a spunbonded web formed from a filament, the apparatus including: a spinneret for forming a filament; a cooling chamber for supplying processing air for cooling the filament provided downstream of the spinneret; and a drawing unit for extending the filament connected to the cooling chamber, wherein a connection area between the cooling chamber and the drawing unit is closed, the drawing unit has a drawing passage in which a passage wall is branched over at least a part of the length of the drawing passage, and in the drawing unit, at the upstream end of the branched drawing passage portion, additional air is injected into the drawing passage under a condition that a filament bundle is widely formed in the machine direction, and a deposition device for depositing a filament of a spunbonded web is provided.

Japanese Patent No. 5094588 describes that there is a deposition unit downstream of the drawing unit, the deposition unit includes an upstream diffuser and an adjacent downstream diffuser, and an ambient air inlet slit is provided between the upstream diffuser and the downstream diffuser.

SUMMARY OF INVENTION

Technical Problem

Meanwhile, examples of important characteristics related to the quality of non-woven fabrics include uniformity and strength. For example, Japanese Patent No. 3135498 aims to obtain a non-woven fabric having a uniform mesh size. However, in non-woven fabrics having high uniformity, the entanglement of the filaments may be insufficient so that the strength is lowered.

The present disclosure has been made in view of the above facts, and an object thereof is to provide an apparatus for manufacturing a non-woven fabric and a method of manufacturing a non-woven fabric capable of obtaining a non-woven fabric with improved strength while suppressing impairment of uniformity.

Solution to Problem

In order to achieve the above object, an apparatus for manufacturing a non-woven fabric of the disclosure comprises a diffusing shaft, the diffusing shaft comprising:

a first shaft portion disposed at an upper side of the shaft and provided with a slit-shaped air guide, wherein filaments are supplied together with air from an inlet side of the air guide to an outlet side of the air guide;

a second shaft portion disposed at a lower side of the shaft, having an inlet side that is communicated with an outlet side of the first shaft portion and an outlet side that is disposed to face a collecting unit that collects the filaments, wherein an opening width along a machine direction of the inlet side of the second shaft portion is larger than an opening width along a machine direction of the first shaft portion; and a stepped portion provided at a connecting portion between the outlet side of the first shaft portion and the inlet side of the second shaft portion and connecting the outlet side of the first shaft portion to the inlet side of the second shaft portion.

A method of manufacturing a non-woven fabric of the disclosure comprises:

using a diffusing shaft including: a first shaft portion disposed at an upper side of the shaft and provided with a slit-shaped air guide, wherein filaments are supplied together with air from an inlet side of the air guide to an outlet side of the air guide; a second shaft portion disposed at a lower side of the shaft, having an inlet side that is communicated with an outlet side of the first shaft portion and an outlet side that is disposed to face a collecting unit that collects the filaments, wherein an opening width along a machine direction of the inlet side of the second shaft portion is larger than an opening width along a machine direction of the first shaft portion; and a stepped portion provided at a connecting portion between the outlet side of the first shaft portion and the inlet side of the second shaft portion and connecting the outlet side of the first shaft portion to the inlet side of the second shaft portion; and supplying the filaments together with the air from the inlet side of the first shaft portion, and collecting and depositing the filaments, which are jetted from the outlet side of the second shaft portion, in the collecting unit to produce a web to be manufactured into a non-woven fabric.

The manufacturing apparatus and the manufacturing method of a non-woven fabric according to the disclosure include: a spinning unit for spinning a plurality of filaments from a molten resin obtained by melting a thermoplastic resin; a cooling unit for cooling the plurality of spun filaments; and a drawing unit for drawing the plurality of filaments, and, in a collecting unit, the plurality of drawn filaments are collected and deposited while being diffused, whereby a web is produced. A diffusing shaft is provided between the drawing unit and the collecting unit, and air (jetting wind) passing through the inside of the diffusing shaft is diffused in the machine direction and is jetted from an opening at the lower side of the diffusing shaft to the collecting unit, whereby a web with high uniformity is produced.

The diffusing shaft includes a first shaft portion and a second shaft portion, and the opening width along the machine direction of the inlet side of the second shaft portion is larger than the opening width along the machine direction of the outlet side of the first shaft portion. The outlet side of the first shaft portion and the inlet side of the second shaft portion are connected by a stepped portion. When a jetting wind introduced from the first shaft portion to the second shaft portion passes through the stepped portion, a region where speed fluctuation is promoted and the speed fluctuation increases is generated inside the jetting wind. Entanglement of a plurality of filaments conveyed by a jetting wind in the second shaft portion of the diffusing shaft is promoted by generation of a region where the speed fluctuation of the jetting wind is large. As a result, a web with increased entanglement of filaments is obtained, and the strength of a non-woven fabric produced from this web is improved by increased entanglement of the filaments.

The stepped portion provided in the diffusing shaft may have any shape as long as the opening width between the first shaft portion and the second shaft portion is increased along the machine direction, thereby to promote speed fluctuation of jetting wind in the second shaft portion, and the stepped portion may be provided at at least one of the machine direction side or the opposite direction side from the machine direction.

In the disclosure, the stepped portion may be provided continuously along the machine width direction at each of the machine direction side and the opposite direction side from the machine direction.

In the disclosure, in the stepped portion, a first stepped portion provided at the machine direction side and a second stepped portion provided at the opposite direction side from the machine direction may be alternately disposed along the machine width direction.

Further, in the disclosure, the second shaft portion may be formed in such a manner that the opening width along the machine direction of the second shaft portion gradually increases from the inlet side to the outlet side of the second shaft portion.

Advantageous Effects of Invention

As described above, the disclosure provides an effect that it is possible to promote generation of entanglement of filaments conveyed through the diffusing shaft by air as jetting wind, thereby obtaining a non-woven fabric whose strength is improved by entanglement of filaments. Therefore, according to the disclosure, it is possible to provide an apparatus for manufacturing a non-woven fabric and a method of manufacturing a non-woven fabric capable of obtaining a non-woven fabric with improved strength while suppressing impairment of uniformity.

DESCRIPTION OF EMBODIMENTS

Figure 1:
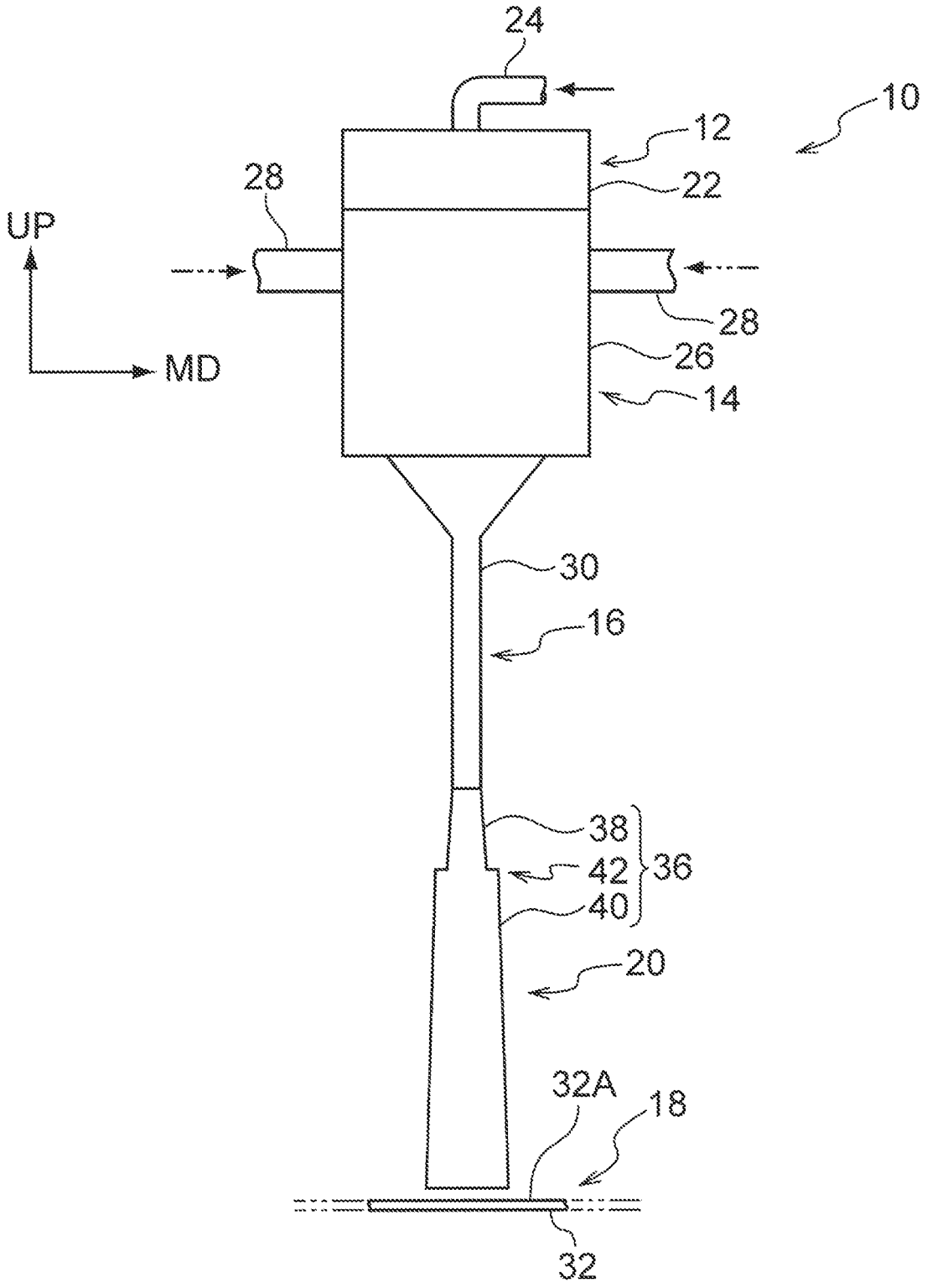
FIG. 1 is a schematic configuration diagram of the apparatus for manufacturing a non-woven fabric according to the embodiment.

Hereinafter, an example of an embodiment of the disclosure will be described in detail with reference to the drawings. FIG. 1 shows a main part of apparatus 10 for manufacturing a non-woven fabric according to the embodiment. The manufacturing apparatus 10 according to the embodiment is used for manufacturing a spunbonded non-woven fabric. In the following description, the MD (machine direction) direction indicates the machine direction, the CD (cross machine direction) direction indicates the width direction (machine width direction) crossing the MD direction, and the UP direction indicates upward direction in the vertical direction.

The manufacturing apparatus 10 includes: a spinning unit 12 for spinning a molten resin obtained by melting a thermoplastic resin used for a spunbonded non-woven fabric to produce filaments; a cooling unit 14 that performs a cooling process on the filaments; and a drawing unit 16 that performs a drawing process on the filaments. The manufacturing apparatus 10 includes: a collecting unit 18 for collecting cooled and drawn filaments to obtain a web to be a non-woven fabric; and a diffusing unit 20 for jetting filaments toward the collecting unit 18.

The spinning unit 12 includes a spinneret 22 including a plurality of spinning nozzles arranged therein, and a molten resin introduction pipe 24 is connected to the spinneret 22. In the spinning unit 12, a molten resin is introduced from the molten resin introduction pipe 24 to the spinneret 22, thereby spinning filaments from the plurality of spinning nozzles. As a result, the spinning unit 12 outputs a plurality of filaments arranged in the CD direction. The cooling unit 14 includes a cooling chamber 26 into which a plurality of spun filaments are introduced, and a cooling wind supply duct 28 is connected to the cooling chamber 26. The cooling unit 14 cools the plurality of filaments introduced into the cooling chamber 26 by cooling wind supplied from the cooling wind supply duct 28.

The drawing unit 16 is provided with a drawing shaft 30 whose opening section is elongated in the CD direction (in FIG. 1, a direction perpendicular to the page) and short in the MD direction, and which extends in the vertical direction. A plurality of filaments are introduced from the cooling unit 14 to the drawing shaft 30 of the drawing unit 16. The drawing unit 16 uses, as drawing wind, cooling wind introduced together with the plurality of filaments or air wind supplied into the drawing shaft 30 separately from the cooling wind, and outputs the filaments introduced from the cooling unit 14 while drawing the filaments.

The collecting unit 18 includes a moving belt 32 as a collecting medium formed of mesh, punching metal, or the like, and suction means (not shown) provided below the moving belt 32. The diffusing unit 20 includes a diffusing shaft 36. The opening at the upper side of the diffusing shaft 36 is directed to the opening at the lower end side of the drawing shaft 30 of the drawing unit 16, and the opening at the lower side of the diffusing shaft 36 is directed onto the collecting surface 32A of the moving belt 32 of the collecting unit 18.

A plurality of cooled and drawn filaments are introduced into the diffusing shaft 36 from the drawing shaft 30. The diffusing unit 20 uses, as a jetting wind, a drawing wind introduced, together with a plurality of filaments, from the drawing shaft 30 to the diffusing shaft 36 or an air wind introduced into the diffusing shaft 36 separately from the drawing wind, conveys the plurality of filaments by the jetting wind, and jets the filaments from an opening at the lower side of the diffusing shaft 36 toward the collecting surface 32A of the moving belt 32. The collecting unit 18 collects the filaments jetted out to the collecting surface 32A of the moving belt 32 on the collecting surface 32A while sucking by suction means, thereby producing a web to be a non-woven fabric.

In the diffusing shaft 36, a slit-shaped air guide is formed. The air guide of the diffusing shaft 36 is formed in such a manner that the opening width (the opening width along the MD direction) of the inside thereof is increased downwardly, and the jetting wind passing through the diffusing shaft 36 spreads (diffuses) along the MD direction. As a result, in the manufacturing apparatus 10, the plurality of filaments are diffused when passing through the diffusing shaft 36 of the diffusing unit 20, and are jetted and deposited on the collecting surface 32A of the collecting unit 18. In the manufacturing apparatus 10, the distance between the lower end of the diffusing shaft 36 and the collecting surface 32A of the moving belt 32 is in the range of from several tens of mm to 100 mm, thereby preventing filaments from diffusing more than necessary after being jetted from the diffusing shaft 36. The manufacturing apparatus 10 may employ a known configuration in which a plurality of filaments are produced by spinning a molten resin, and the plurality of produced filaments are cooled and drawn, and collected.

Figure 2:
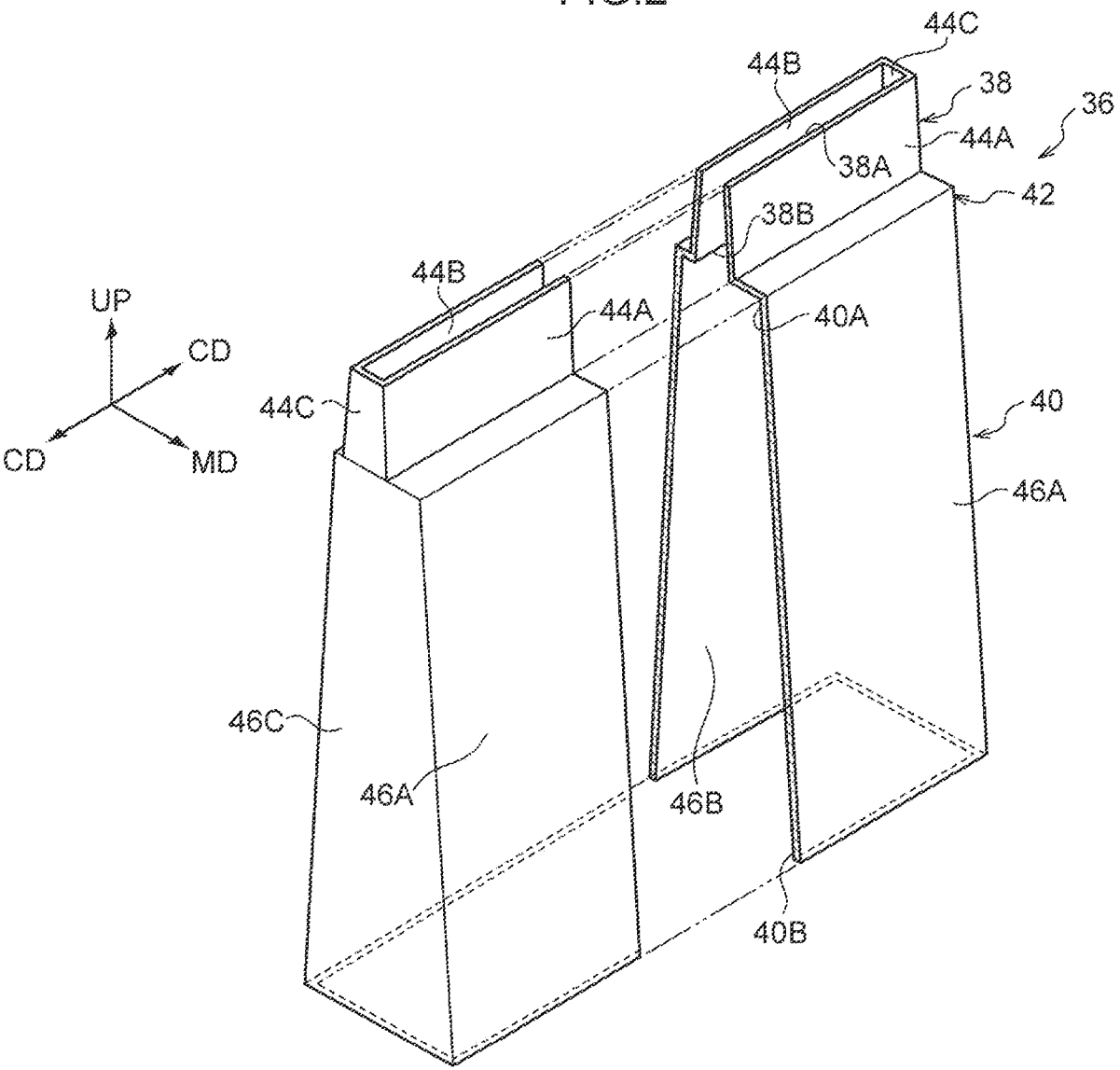
FIG. 2 is a schematic perspective view showing a diffusing shaft of a diffusing unit according to the embodiment.
Figure 3A:
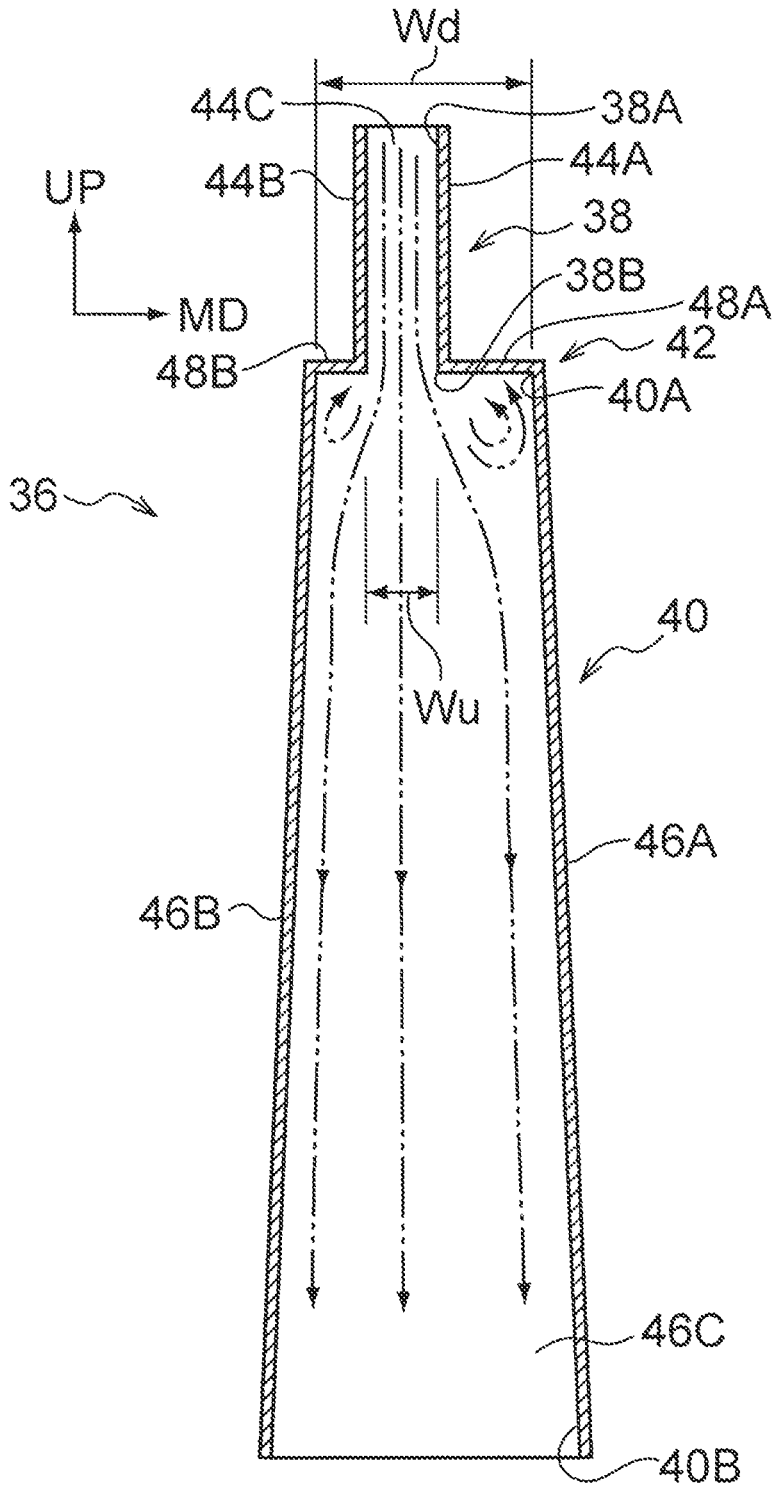
FIG. 3A is a schematic sectional view of a diffusing shaft according to the embodiment.

FIG. 2 and FIG. 3A show the diffusing shaft 36 of the diffusing unit 20. As shown in FIGS. 1 to 3A, the diffusing shaft 36 includes an upper shaft 38 as a first shaft portion and a lower shaft 40 as a second shaft portion. In the diffusing shaft 36, a stepped portion 42 is provided at a connecting portion between the upper shaft 38 and the lower shaft 40. In the diffusing shaft 36, the length of the lower shaft 40 along the vertical direction is made longer than that of the upper shaft 38, and the stepped portion 42 is formed above the intermediate portion in the vertical direction of the diffusing shaft 36.

As shown in FIG. 2, in the upper shaft 38, a wall portion 44A and a wall portion 44B are disposed in pairs along the MD direction, and a pair of side wall portions 44C are disposed in the CD direction. The upper shaft 38 is formed by the wall portions 44A and 44B and the pair of side wall portions 44C into an elongated rectangular tubular shape having an upper end opening 38A and a lower end opening 38B whose opening sections are narrow in the MD direction and long in the CD direction.

As shown in FIG. 2 and FIG. 3A, the opening width (the opening width along the MD direction) and the opening length (the opening length along the CD direction) of the opening 38A at the upper end of the upper shaft 38 are aligned with an opening (not shown) at the lower end portion of the drawing shaft 30 (see FIG. 1), and a plurality of filaments output from the drawing shaft 30 are introduced into the drawing shaft 30. The wall portions 44A and 44B of the upper shaft 38 may be parallel to each other or slightly inclined in such a manner that the opening width gradually increases from the opening 38A to the opening 38B. In the embodiment, the wall portions 44A and 44B are inclined in such a manner that the opening width gradually increases from the opening 38A to the opening 38B, whereby the opening width of the opening 38B at the lower end of the upper shaft 38 is slightly larger than the opening width of the opening 38A at the upper end.

As shown in FIG. 2, in the lower shaft 40, a wall portion 46A and a wall portion 46B are disposed in pairs along the MD direction, and a pair of side wall portions 46C (only one of the portions is shown in FIG. 2) are disposed in the CD direction. The lower shaft 40 is formed by the wall portions 46A and 46B and the pair of side wall portions 46C into an elongated rectangular tubular shape having an upper end opening 40A and a lower end opening 40B whose opening sections are narrow in the MD direction and long in the CD direction.

In the lower shaft 40, the opening 40A at the upper end is opposed to the opening 38B of the upper shaft 38, and the opening 40B at the lower end is opposed to the moving belt 32 of the collecting unit 18. As shown in FIGS. 2 and 3A, in the lower shaft 40, the wall portions 46A and 46B are inclined in such a manner that the opening width gradually increases from the opening 40A to the opening 40B. As a result, the opening width of the lower shaft 40 gradually increases from the upper end opening 40A to the lower end opening 40B, and the opening width of the lower end opening 40B is larger than the opening width of the upper end opening 40A. It is sufficient that the opening width of the lower shaft 40 does not decrease at least from the upper end opening 40A toward the lower end opening 40B, and the lower shaft 40 may have a configuration in which the opening width does not change from the upper end opening 40A toward the lower end opening 40B.

On the other hand, as shown in FIG. 3A, in the diffusing shaft 36, the opening width Wd of the opening 40A at the upper end of the lower shaft 40 is larger than the opening width Wu of the opening 38B at the lower end of the upper shaft 38 (Wu<Wd). As shown in FIG. 2 and FIG. 3A, the stepped portion 42 is provided with connecting wall portions 48A and 48B, and each of the connecting wall portions 48A and 48B is disposed along a direction (horizontal direction) intersecting the vertical direction. In the stepped portion 42, the lower end of the side wall portion 44C of the upper shaft 38 and the upper end of the side wall portion 46C of the lower shaft 40 are integrally connected.

In the stepped portion 42, the lower end portion of the wall portion 44A at the MD direction side of the upper shaft 38 and the upper end portion of the wall portion 46A at the MD direction side of the lower shaft 40 are connected and closed by the connecting wall portion 48A. In the stepped portion 42, the lower end portion of the wall portion 44B of the upper shaft 38 and the upper end portion of the wall portion 46B of the lower shaft 40 are connected and closed by the connecting wall portion 48B. As a result, in the diffusing shaft 36, the inside of the upper shaft 38 and the inside of the lower shaft 40 are communicated with each other, and the opening width along the MD direction is increased, from the upper shaft 38 side to the lower shaft 40 side, in the stepped portion 42. In other words, in the stepped portion 42, the wall portion 46A protrudes from the wall portion 44A in the MD direction to form a step, the wall portion 46B protrudes from the wall portion 44B in a direction opposite to the MD direction, and a step continuous in the CD direction is formed.

In the diffusing shaft 36, the width dimension (MD direction dimension) of the connecting wall portion 48A is made larger than the width dimension of the connecting wall portion 48B. As a result, in the diffusing shaft 36, the lower shaft 40 is biased in the MD direction and connected to the upper shaft 38.

In the diffusing shaft 36, the opening width is increased at the stepped portion 42, and the change (change rate) in the opening width in the stepped portion 42 is larger than the change in the opening width in the upper shaft 38, and is larger than the change in the opening width in the lower shaft 40.

Next, a function of the diffusing unit 20 provided in the manufacturing apparatus 10 according to the embodiment will be described.

The diffusing unit 20 is provided with a diffusing shaft 36, and the filaments which are spun, cooled and drawn, and output from the drawing shaft 30 of the drawing unit 16 is introduced into the diffusing shaft 36. A jetting wind is introduced into the diffusing shaft 36. The diffusing shaft 36 is formed by connecting the upper shaft 38 and the lower shaft 40, and the opening width is increased in the MD direction from the opening 38A of the upper shaft 38 toward the opening 40B of the lower shaft 40.

In the diffusing unit 20, the jetting wind introduced into the diffusing shaft 36 is diffused in the diffusing shaft 36, and is jetted from the opening 40B. The filament introduced into the diffusing shaft 36 is diffused by the jetting wind, and is diffused and jetted toward the collecting surface 32A of the moving belt 32 provided in the collecting unit 18. As a result, in the manufacturing apparatus 10, filaments are uniformly diffused and deposited on the collecting surface 32A of the moving belt 32.

Incidentally, the diffusing shaft 36 is provided with the stepped portion 42. The stepped portion 42 connects the wall portions 44A and 44B of the upper shaft 38 and the wall portions 46A and 46B of the lower shaft 40 by the connecting wall portions 48A and 48B disposed along the horizontal direction. Since the diffusing shaft 36 is provided with the stepped portion 42, the opening width of the diffusing shaft 36 is largely changed in the stepped portion 42 as compared with the change in the opening width in the upper shaft 38 and the change in the opening width in the lower shaft 40.

Figure 3B:
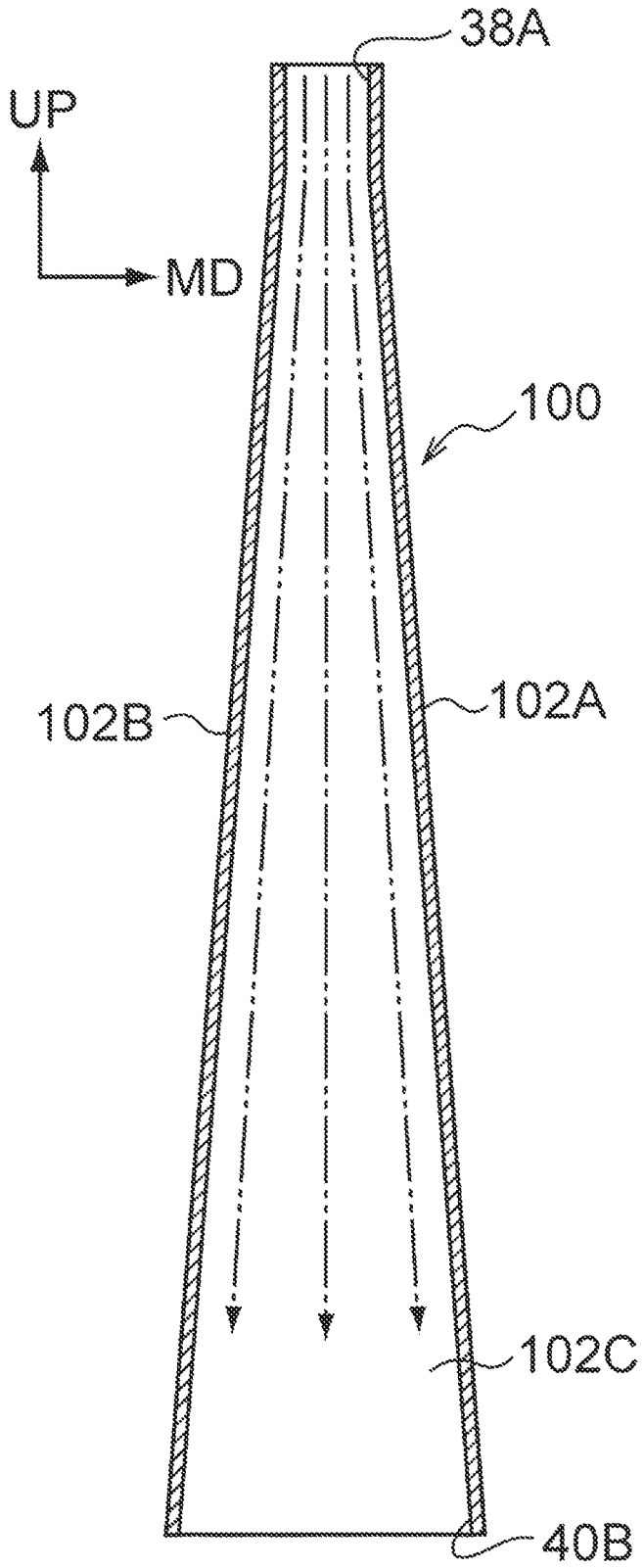
FIG. 3B is a schematic sectional view of a diffusing shaft to be compared.

Here, in FIG. 3A, the outline of the flow of a jetting wind on the diffusing shaft 36 is shown by double-dotted chain arrows. FIG. 3B shows a diffusing shaft 100 to be compared. In the diffusing shaft 100, a wall portion 102A and a wall portion 102B are disposed in pairs along the MD direction, and a pair of side wall portions 102C (only one of the portions is shown in FIG. 3B) are disposed in the CD direction. The diffusing shaft 100 is formed in a tubular shape in which the wall portions 102A and 102B are inclined in such a manner that the opening section gradually increases from the upper side to the lower side, and an opening 38A is provided at the upper end and an opening 40B is provided at the lower end. In other words, the diffusing shaft 100 is different from the diffusing shaft 36 in that the stepped portion 42 is not provided.

In the diffusing shaft 100, a jetting wind introduced from the opening 38A spreads in the MD direction in accordance with the increase in the opening width of the diffusing shaft 100, and is jetted from the opening 40B. Although the speed of the jetting wind decreases according to the friction with the inner surfaces of the wall portions 102A and 102B and the side wall portions 102C and the like and an increase in the opening width, and a speed fluctuation occurs, the speed fluctuation is suppressed in the diffusing shaft 100. Therefore, in the diffusing shaft 100, since speed fluctuation of a jetting wind is suppressed, entanglement of a plurality of filaments conveyed by the jetting wind in the diffusing shaft 100 is suppressed.

In contrast, as shown in FIG. 3A, in the diffusing shaft 36, the connecting wall portions 48A and 48B extending in the horizontal direction are provided at the stepped portion 42, and the jetting wind (the main flow of the jetting wind is indicated by the double-dotted chain arrow) that has passed through the stepped portion 42 spreads. A speed fluctuation occurs in the entire jetting wind by spread of the jetting wind. In the diffusing shaft 36, the stepped portion 42 having a larger change in opening width than the upper shaft 38 and the lower shaft 40 is provided, and the jetting wind spreads at the stepped portion 42, and as a result, a region where the speed fluctuation is promoted more than the surroundings is generated in the jetting wind. A plurality of filaments which are conveyed by the jetting wind are slightly entangled with each other, and a region where the speed fluctuation is promoted more than the surroundings generated in the jetting wind promotes entanglement of the filaments conveyed by the jetting wind.

As a result, the filaments jetted from the diffusing shaft 36 provided with the stepped portion 42 are more entangled than the filaments jetted from the diffusing shaft 100 not provided with the stepped portion 42. Therefore, on the collecting surface 32A of the collecting unit 18, a web in which more entangled filaments are deposited is produced.

In general, non-woven fabrics with many entanglements of filaments have higher strength than non-woven fabrics with few entanglements of filaments. Accordingly, in the manufacturing apparatus 10, since the stepped portion 42 is provided in the diffusing shaft 36, a non-woven fabric having high strength can be produced.

In the embodiment, the diffusing shaft 36 in which, by making the width dimension (dimension in the MD direction) of the connecting wall portion 48A larger than the width dimension of the connecting wall portion 48B, the lower shaft 40 is biased in the MD direction with respect to the upper shaft 38 has been described as an example, but the diffusing shaft is not limited thereto.

Figure 4A:
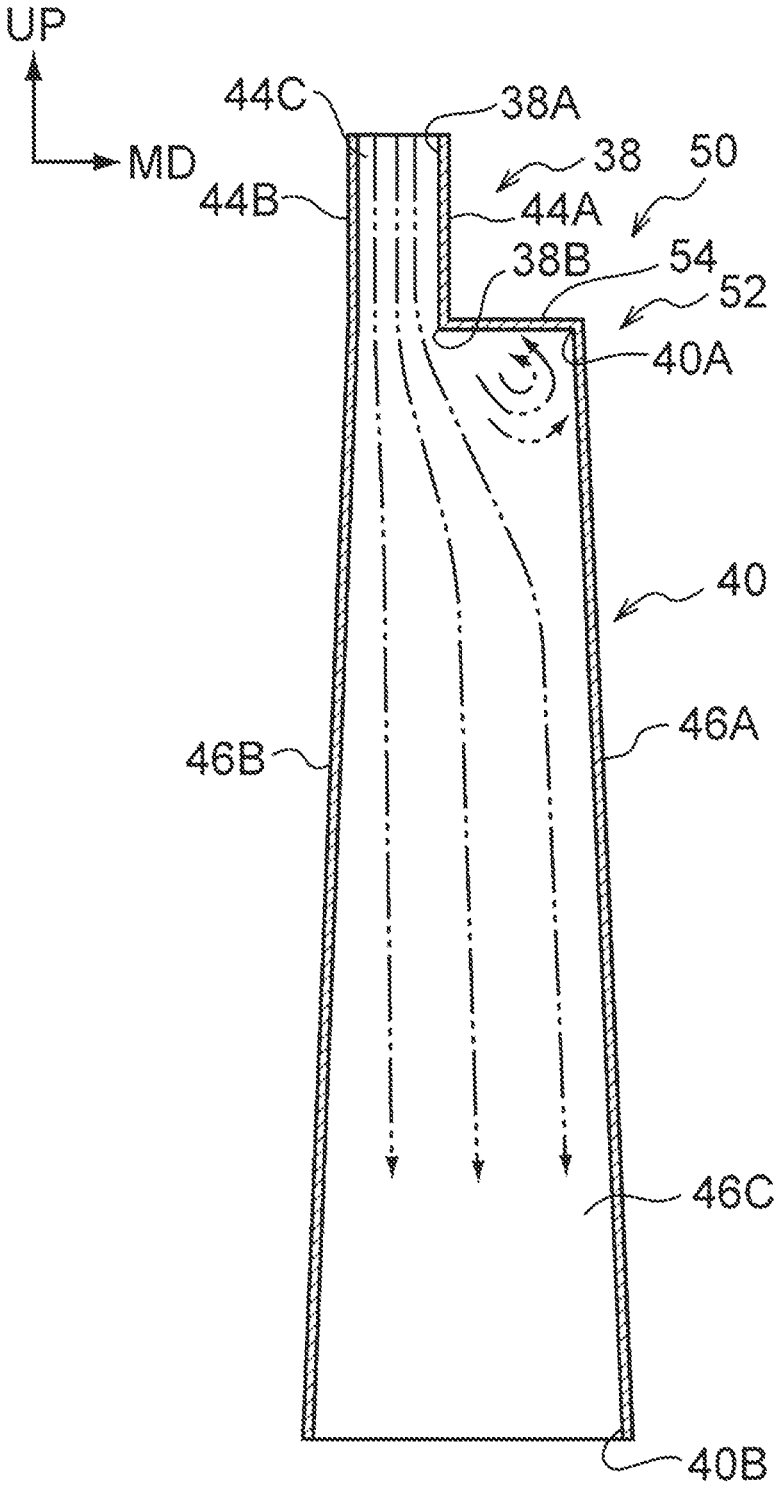
FIG. 4A is a schematic perspective view showing another example of a diffusing shaft.
Figure 4B:
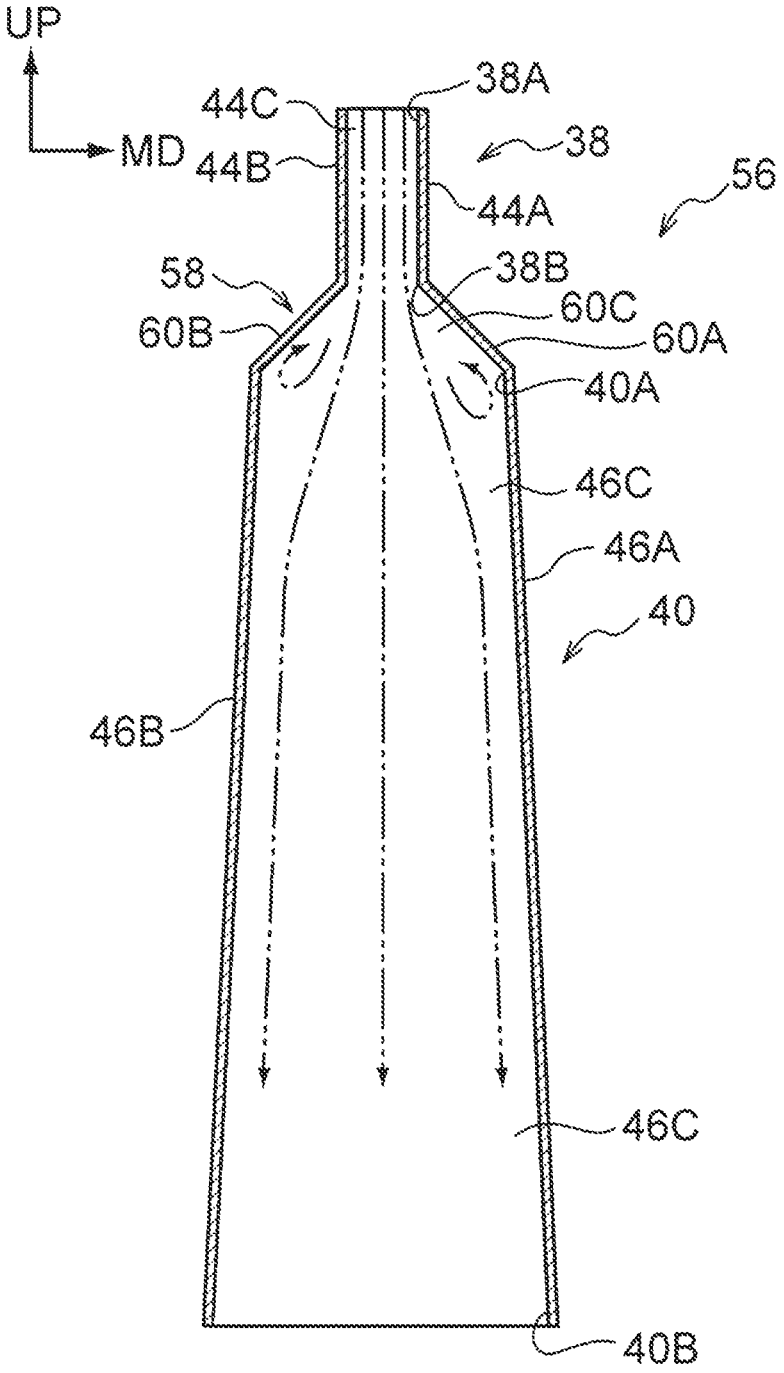
FIG. 4B is a schematic perspective view showing another example of a diffusing shaft.
Figure 4C:
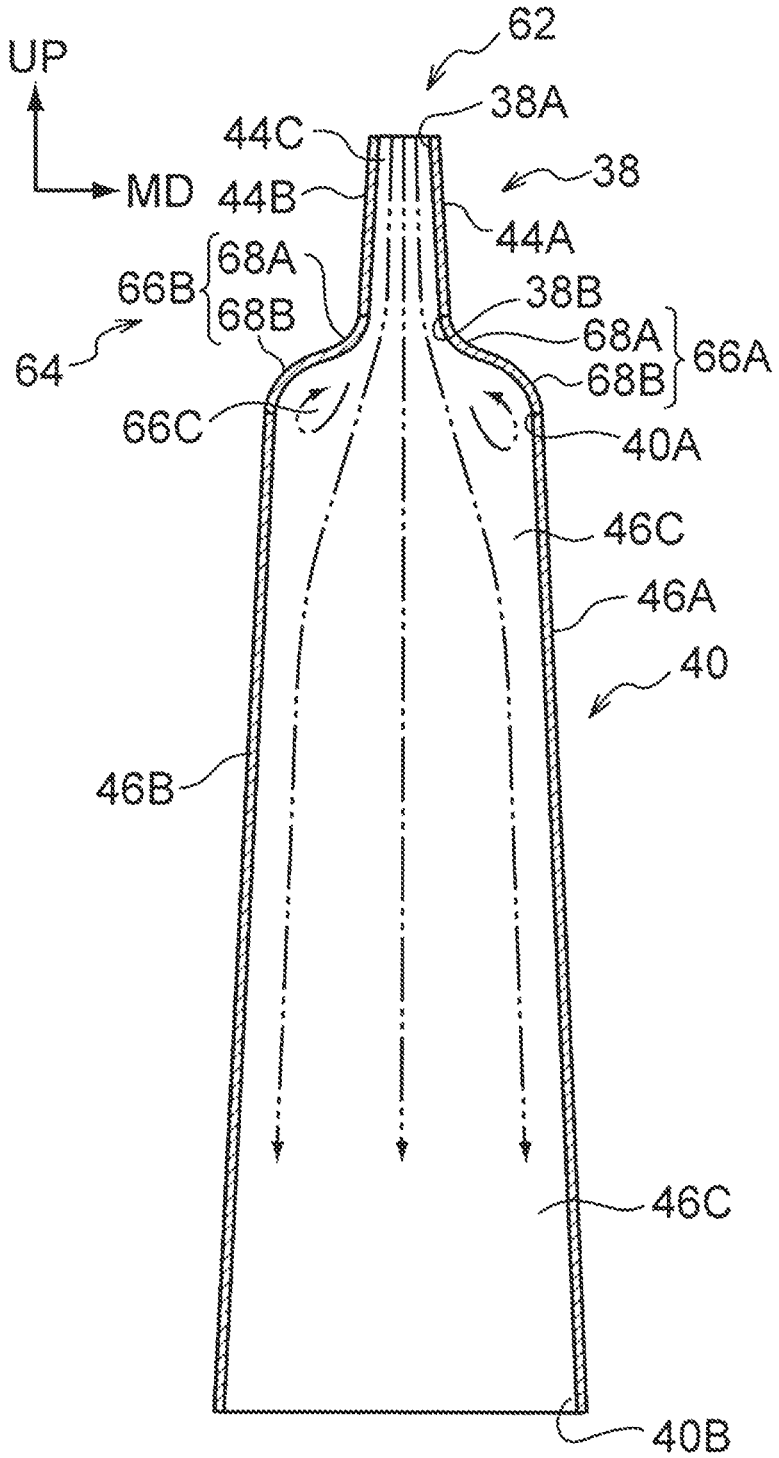
FIG. 4C is a schematic perspective view showing another example of a diffusing shaft.

FIGS. 4A to 4C show diffusing shafts having shapes different from that of the diffusing shaft 36. In a diffusing shaft 50 shown in FIG. 4A, a stepped portion 52 is provided between the upper shaft 38 and the lower shaft 40, and the stepped portion 52 is provided with a connecting wall portion 54 disposed in the horizontal direction. In the diffusing shaft 50, the wall portion 44B of the upper shaft 38 and the wall portion 46B of the lower shaft 40 are connected. In the diffusing shaft 50, the lower end of the wall portion 44A of the upper shaft 38 and the upper end of the wall portion 46A of the lower shaft 40 are connected by the connecting wall portion 54 of the stepped portion 52.

As a result, in the stepped portion 52 of the diffusing shaft 50, the opening width is increased by a step formed between the inner surface of the wall portion 44A and the inner surface of the wall portion 46A, and the jetting wind passing through the stepped portion 52 expands toward the MD direction side. Accordingly, in the diffusing shaft 50, a region where velocity fluctuation is promoted is generated in the jetting wind diffused in the lower shaft 40, and entanglement of the filaments is promoted by promoting velocity fluctuation of the jetting wind. Therefore, by using the diffusing shaft 50, it is possible to manufacture a non-woven fabric having high strength.

The stepped portion may be formed by forming a step in the MD direction and the opposite direction to the MD direction by connecting wall portions having the same width dimension to connect the upper shaft 38 and the lower shaft 40. In other words, the diffusing shaft may be any diffusing shaft as long as a stepped portion having an opening width increasing in at least one direction in the MD direction and the opposite direction to the MD direction is formed at a connecting portion between the first shaft portion and the second shaft portion.

In the diffusing shaft 56 shown in FIG. 4B, the upper shaft 38 and the lower shaft 40 are connected by a stepped portion 58. Connecting wall portions 60A and 60B having the same width dimension and connecting side wall portions 60C are used for the stepped portion 58, and the connecting wall portions 60A and 60B are inclined in such a manner that the lower shaft 40 side is downward with respect to the horizontal direction. In the stepped portion 58, the side wall portion 44C of the upper shaft 38 and the side wall portion 46C of the lower shaft 40 are connected by the connecting side wall portion 60C. In the stepped portion 58, the wall portion 44A of the upper shaft 38 and the wall portion 46A of the lower shaft 40 are connected by the connecting wall portion 60A, and the wall portion 44B of the upper shaft 38 and the wall portion 46B of the lower shaft 40 are connected by the connecting wall portion 60B.

The inclinations of the connecting wall portions 60A and 60B at the stepped portion 58 of the diffusing shaft 56 (the inclination with respect to the direction of a jetting wind in the upper shaft 38) are such that a change in the opening width between the connecting wall portions 60A and 60B can promote the speed fluctuation in the jetting wind. In the thus formed diffusing shaft 56, a region in which velocity fluctuation is accelerated generated in the jetting wind that has passed through the stepped portion 58 can promote generation of entanglement of filaments, thereby manufacturing a non-woven fabric with high strength.

In the diffusing shaft 62 shown in FIG. 4C, a stepped portion 64 is provided between the upper shaft 38 and the lower shaft 40, and the upper shaft 38 and the lower shaft 40 are connected by the stepped portion 64. In the diffusing shaft 62, the opening width of the opening 38A at the upper end is reduced with respect to the opening 38B at the lower end of the upper shaft 38.

The stepped portion 64 of the diffusing shaft 62 is provided with a connecting wall portion 66A at the MD direction side and a connecting wall portion 66B at the opposite side from the MD direction. A curved portion 68A that is convex downward is disposed at the upper side of the connecting wall portions 66A and 66B, and a curved portion 68B that is convex upward is disposed at the lower side of the connecting wall portions 66A and 66B. The connecting wall portion 66A is formed by connecting the curved portions 68A and 68B. The stepped portion 64 is provided with connecting wall portions 66A and 66B in such a manner that the convex sides of the curved portions 68A face each other. In the stepped portion 64, the connecting side wall portions 66C are provided in a pair at the CD direction sides, and the connecting wall portions 66A and 66B are connected by the connecting side wall portions 66C.

In the steppe portion 64, the wall portion 44A of the upper shaft 38 and the wall portion 46A of the lower shaft 40 are connected by the connecting wall portion 66A, and the wall portion 44B of the upper shaft 38 and the wall portion 46B of the lower shaft 40 are connected by the connecting wall portion 66B. In the stepped portion 64, the side wall portion 44C of the upper shaft 38 and the side wall portion 46C of the lower shaft 40 are connected by the connecting side wall portion 66C.

As described above, the stepped portion 64 of the diffusing shaft 62 uses the connecting wall portions 66A and 66B whose inner surface is curved, and the opening width changes in such a manner to expand from the upper end to the lower end, and the rate of change of the opening width is increased in the middle part than in the upper part and the lower part. As a result, also in the diffusing shaft 62, a region where velocity fluctuation is promoted is generated in the jetting wind that has passed through the stepped portion 64, and generation of entanglement in the filaments can be promoted, whereby a non-woven fabric having high strength can be manufactured.

Figure 5:
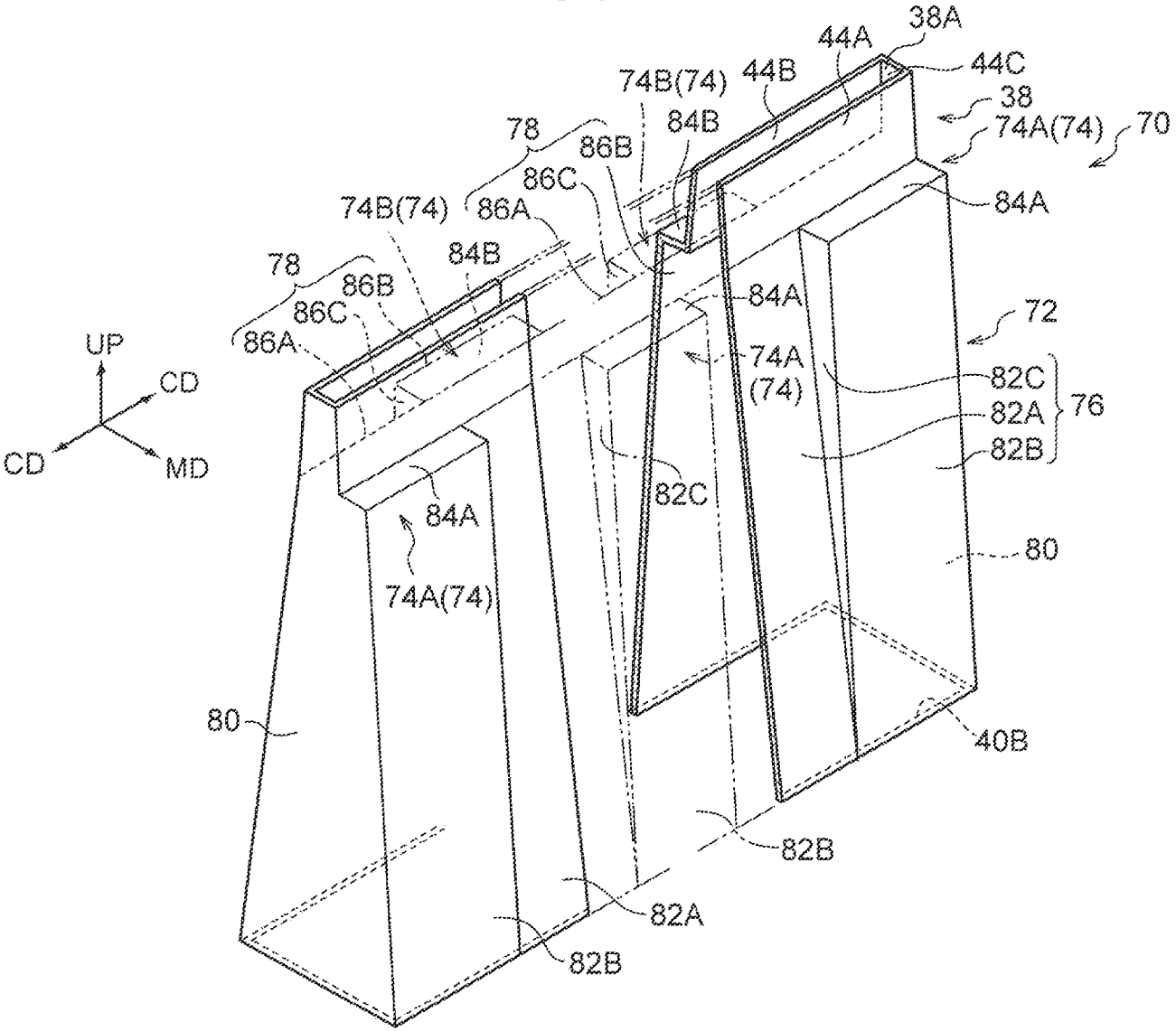
FIG. 5 is a schematic sectional view showing another example of a diffusing shaft.

Further, in the above description, the step is formed over the entire area in the CD direction with respect to at least one of the MD direction side and the opposite side from the MD direction, but the disclosure is not limited thereto, and a stepped portion may be alternately formed at the MD direction side and at the side opposite from the MD direction. FIG. 5 shows a diffusing shaft 70 as this example.

The diffusing shaft 70 has a lower shaft 72 as a second shaft portion, and the upper shaft 38 and the lower shaft 72 are connected at a stepped portion 74. In the lower shaft 72, a wall portion 76 is disposed at the MD direction side, and a wall portion 78 is disposed at the opposite direction side from the MD direction. The lower shaft 72 is formed in a substantially tubular shape in which a pair of side wall portions 80 are disposed at the CD direction sides, wall portions 76 and 78 are connected by the side wall portion 80, and a lower end is an opening 40B. The stepped portion 74 includes a stepped portion 74A serving as a first stepped portion provided at the MD direction side (the wall portion 76 side) and a stepped portion 74B serving as a second stepped portion provided at the opposite direction side from the MD direction (the wall portion 78 side).

A wall portion 76 of the lower shaft 72 includes a vertical wall 82A whose upper end is in contact with the lower end of the wall portion 44A of the upper shaft 38 and a vertical wall 82B whose upper end is separated from the lower end of the wall portion 44A of the upper shaft 38 in the MD direction, the vertical wall 82A and the vertical wall 82B being alternately disposed in the CD direction, and a side wall 82C connecting the mutually adjacent vertical walls 82A and 82B. The stepped portion 74A is formed by connecting the lower end of the wall portion 44A and the upper end of the vertical wall 82B of the wall portion 76 by a connecting wall portion 84A disposed in the horizontal direction. As a result, in the diffusing shaft 70, the stepped portions 74A are formed at a predetermined interval along the CD direction.

A wall portion 78 of the lower shaft 72 includes a vertical wall 86A whose upper end is in contact with the lower end of the wall portion 44B of the upper shaft 38 and a vertical wall 86B whose upper end is separated from the lower end of the wall portion 44B of the upper shaft 38 in the direction opposite to the MD direction, the vertical wall 86A and the vertical wall 86B being alternately disposed in the CD direction, and a side wall 86C connecting the mutually adjacent vertical walls 86A and 86B.

The stepped portion 74B is formed by connecting the lower end of the wall portion 44B of the upper shaft 38 and the upper end of the vertical wall 86B of the wall portion 78 by a connecting wall portion 84B disposed in the horizontal direction. As a result, in the diffusing shaft 70, the stepped portions 74B are formed at a predetermined interval along the CD direction. In the wall portion 78, the vertical wall 86A faces the vertical wall 82B of the wall portion 76, and the vertical wall 86B faces the vertical wall 82A of the wall portion 76. As a result, in the diffusing shaft 70, the stepped portion 74A and the stepped portion 74B are alternately formed along the CD direction.

The thus formed diffusing shaft 70 includes stepped portions 74A and 74B whose opening widths change in such a manner to promote speed fluctuation of the jetting wind between the upper shaft 38 and the lower shaft 72. As a result, the diffusing shaft 70 can promote generation of entanglement of filaments, whereby a non-woven fabric having high strength can be manufactured. In the diffusing shaft 70, since the stepped portion 74A at the MD direction side and the stepped portion 74B at the opposite side from the MD direction are alternately provided along the CD direction, the occurrence of a change in the degree of entanglement of the filaments along the CD direction can be suppressed, whereby a non-woven fabric having high uniformity and high strength can be manufactured.

The disclosure of Japanese Patent Application No. 2016-068805, filed Mar. 30, 2016, is herein incorporated by reference in its entirety.

All documents, patent applications, and technical standards described in this specification are incorporated herein by reference to the same extent as if each individual document, patent application, or technical standard was specifically and individually indicated to be incorporated by reference.

The invention claimed is:

1. An apparatus for manufacturing a non-woven fabric, the apparatus comprising a diffusing shaft, and the diffusing shaft comprising:

a first shaft portion disposed at an upper side of the shaft and provided with a slit-shaped air guide in which a longitudinal direction of the slit-shaped air guide is a machine width direction, wherein filaments are supplied together with air from an inlet side of the air guide to an outlet side of the air guide, and wherein the first shaft portion is configured so that an opening width along a machine direction of the first shaft portion gradually increases from the inlet side of the air guide towards the outlet side of the air guide;

a second shaft portion disposed at a lower side of the shaft, having an inlet side that is communicated with an outlet side of the first shaft portion and an outlet side that is disposed to face a collecting unit that collects the filaments, wherein an opening width along a machine direction of the inlet side of the second shaft portion is larger than an opening width along a machine direction of the outlet side of the first shaft portion, and wherein the second shaft portion is configured so that the opening width along a machine direction of the second shaft portion gradually increases from the inlet side of the air guide towards the outlet side of the air guide; and a stepped portion provided at a connecting portion between the outlet side of the first shaft portion and the inlet side of the second shaft portion and connecting the outlet side of the first shaft portion to the inlet side of the second shaft portion in a manner in which a centerline along the machine direction of the second shaft portion is biased at one side along the machine direction relative to a centerline along the machine direction of the first shaft portion.

2. The apparatus for manufacturing a non-woven fabric according to claim 1, wherein the stepped portion is continuously provided along a machine width direction at each of a machine direction side and an opposite direction side from the machine direction.

3. A method of manufacturing a non-woven fabric, the method comprising:

using a diffusing shaft including: a first shaft portion disposed at an upper side of the shaft and provided with a slit-shaped air guide in which a longitudinal direction of the slit-shaped air guide is a machine width direction, wherein filaments are supplied together with air from an inlet side of the air guide to an outlet side of the air guide, and wherein the first shaft portion is configured so that an opening width along a machine direction of the first shaft portion gradually increases from the inlet side of the air guide towards the outlet side of the air guide;

a second shaft portion disposed at a lower side of the shaft, having an inlet side that is communicated with an outlet side of the first shaft portion and an outlet side that is disposed to face a collecting unit that collects the filaments, wherein an opening width along a machine direction of the inlet side of the second shaft portion is larger than an opening width along a machine direction of the outlet side of the first shaft portion, and wherein the second shaft portion is configured so that the opening width along a machine direction of the second shaft portion gradually increases from the inlet side of the air guide towards the outlet side of the air guide;

and a stepped portion provided at a connecting portion between the outlet side of the first shaft portion and the inlet side of the second shaft portion and connecting the outlet side of the first shaft portion to the inlet side of the second shaft portion in a manner in which a centerline along the machine direction of the second shaft portion is biased at one side along the machine direction relative to a centerline along the machine direction of the first shaft portion; and supplying the filaments together with the air from the inlet side of the first shaft portion, and collecting and depositing the filaments, which are jetted from the outlet side of the second shaft portion, in the collecting unit to produce a web to be manufactured into a non-woven fabric.

4. The method of manufacturing a non-woven fabric according to claim 3, wherein the stepped portion of the diffusing shaft is provided continuously along a machine width direction at each of a machine direction side and an opposite direction side from the machine direction.

* * * * *